US006601252B1

(12) United States Patent
Leach

(10) Patent No.: US 6,601,252 B1
(45) Date of Patent: Aug. 5, 2003

(54) DOUBLE PILLOWCASE WITH ATTACHED ANCHOR PAD

(76) Inventor: Jamie S. Leach, 130 E. 10th St. P.O. Box 717, Ada, OK (US) 74820

( * ) Notice: Subject to any disclaimer, the term of this patent is extended or adjusted under 35 U.S.C. 154(b) by 0 days.

(21) Appl. No.: 10/090,089

(22) Filed: Mar. 5, 2002

(51) Int. Cl.[7] ..... A47C 20/00

(52) U.S. Cl. ..... 5/632; 5/630; 5/640; 5/420; 5/643

(58) Field of Search ..... 5/630, 632, 633, 5/640, 643, 419, 420, 490

(56) References Cited

U.S. PATENT DOCUMENTS

| | | | | | |
|---|---|---|---|---|---|
| 395,043 | A | | 12/1888 | Doremus | |
| 1,447,288 | A | | 3/1923 | Emmerich | |
| 2,857,957 | A | * | 10/1958 | Gay | 297/114 |
| 3,604,026 | A | * | 9/1971 | Scheips | 297/397 |
| 4,194,254 | A | * | 3/1980 | Torrez | 5/420 |
| 4,393,530 | A | * | 7/1983 | Stark | 5/640 |
| 4,550,459 | A | | 11/1985 | Endel et al. | |
| 4,654,907 | A | * | 4/1987 | Haugaard | 5/420 |
| 4,685,163 | A | * | 8/1987 | Quillen et al. | 5/455 |
| D299,988 | S | * | 2/1989 | Parabita | D6/368 |
| 4,853,994 | A | * | 8/1989 | Ekstein | 5/639 |
| 5,572,753 | A | | 11/1996 | Ruscitto | |

* cited by examiner

*Primary Examiner*—Teri Pham Luu
(74) *Attorney, Agent, or Firm*—William S. Dorman

(57) ABSTRACT

A double pillowcase assembly comprising a pair of fabric envelopes connected together along a central seam line, the envelopes being capable of holding pillows therein and an anchor pad extending outwardly from the double pillowcase and being connected thereto along the central seam line.

2 Claims, 3 Drawing Sheets

DOUBLE PILLOWCASE WITH ATTACHED ANCHOR PAD

BACKGROUND OF THE INVENTION

1. Field of the Invention

The present invention relates to a double pillowcase stitched in the middle to connect the two halves of the pillowcase together. More particularly, the present invention includes a lightly cushioned and quilted anchor pad which is attached to the double pillowcase along the middle line of stitching 2. The Prior Art Double pillows and double pillowcases are known in the art. Patent No. 1,447,288 to Emmerich shows a double pillowcase in which pillows are received. The pillowcase sections are connected together along a center seam.

Ruscitto Patent No. 5,572,753, shows a double pillowcase provided with the envelopes for inserting pillows. However, the Patentee prefers to have one pillowcase empty and to use it as a head cover over the other pillow.

Endel et al, Patent No. 4,550,459, shows three pillows connected together along a single seam. In the case of Endel et al, one of the pillows is larger and the other two pillows are smaller and of equal size.

Doremus, Patent No. 395,043, shows three pillows connected together along a central seam.

SUMMARY OF THE INVENTION

The present invention involves a double pillowcase which includes a pair of fabric envelopes connected together along a central seam line, the envelopes being substantially rectangular in shape and being capable of holding pillows therein. The double pillowcase assembly further includes an anchor pad extending outwardly from the pillowcase and being connected thereto along the central seam line. The double pillowcase can be used in a conventional manner without relying on the anchor pad. However the anchor pad is an essential ingredient of the double pillowcase assembly because it permits, in one form of the invention, a user to sit on the anchor pad with the double pillows positioned behind the head and shoulders of the user. The placement of the body on the anchor pad, in this situation, prevents the pillows from scooting out from under the head of the user. Similarly, if one wishes to use the pillow assembly for elevation of the legs, the position of the body is reversed so that the user places his or her buttocks adjacent to the center seam line with his or her legs draped over the double pillows. A conventional pillow can then be used to support the head of the user. In this case the position of the body of the user on the anchor pad again prevents the pillows from scooting out from beneath the supporting position for the legs. Finally, the anchor pad permits the user to lie crosswise across the anchor pad with the pillows behind the back of the user to provide back support. A conventional pillow can also be used to support the head of the user. In this way the user can recline comfortably with the pillows providing back support or, in the case of a young mother, an infant can be supported in the mother's arms for breastfeeding as desired.

DETAILED DESCRIPTION OF THE PREFERRED EMBODIMENTS

Figure 1:
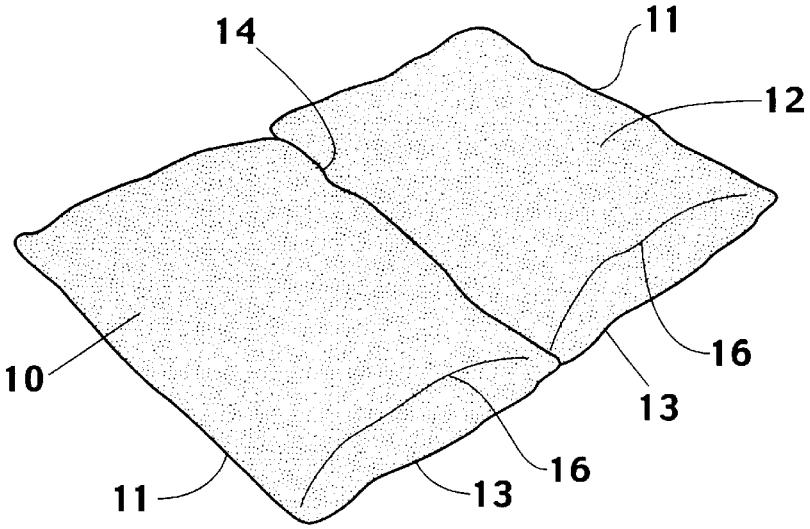
FIG. 1 is a perspective view of the double pillowcase with pillows inside and the anchor pad hidden beneath the pillows.

Referring to the drawings in detail, FIG. 1 shows two pillow case sections 10 and 12 connected together along a center seam line 14. Both the pillowcase sections 10 and 12 in FIG. 1 are substantially rectangular in shape and are shown as fabric envelopes being filled with pillows which have been inserted through the openings 16.

The pillowcases can be made from any material which is used to make conventional pillowcases. Preferably, the pillowcases 10 and 12 can be made from a 50% cotton, 50% polyester cloth, but 100% cotton or nylon wipe-able fabric can be used.

Figure 2:
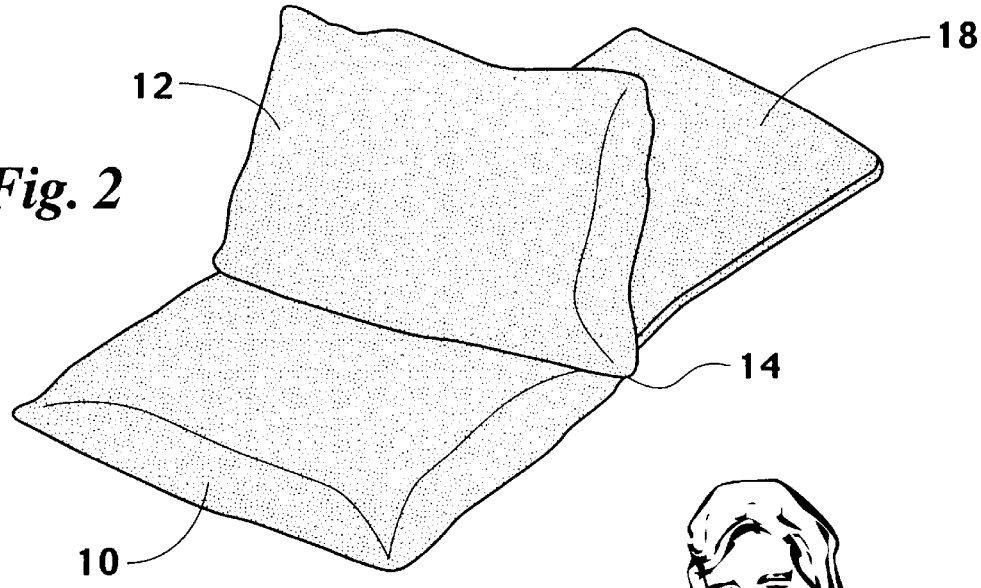
FIG. 2 is a perspective view similar to FIG. 1 but showing the upper pillow rotated slightly counterclockwise to expose the anchor pad.

In FIG. 2 the right hand pillow arrangement 12 is rotated slightly counterclockwise to reveal an anchor pad 18 which is also attached to the two pillowcase sections 10 and 12 along the center seam line 14. For convenience, the pillowcase sections will also be referred to as "pillows" hereinafter. The anchor pad 18 is cushioned with a polyester batting.

Figure 3:
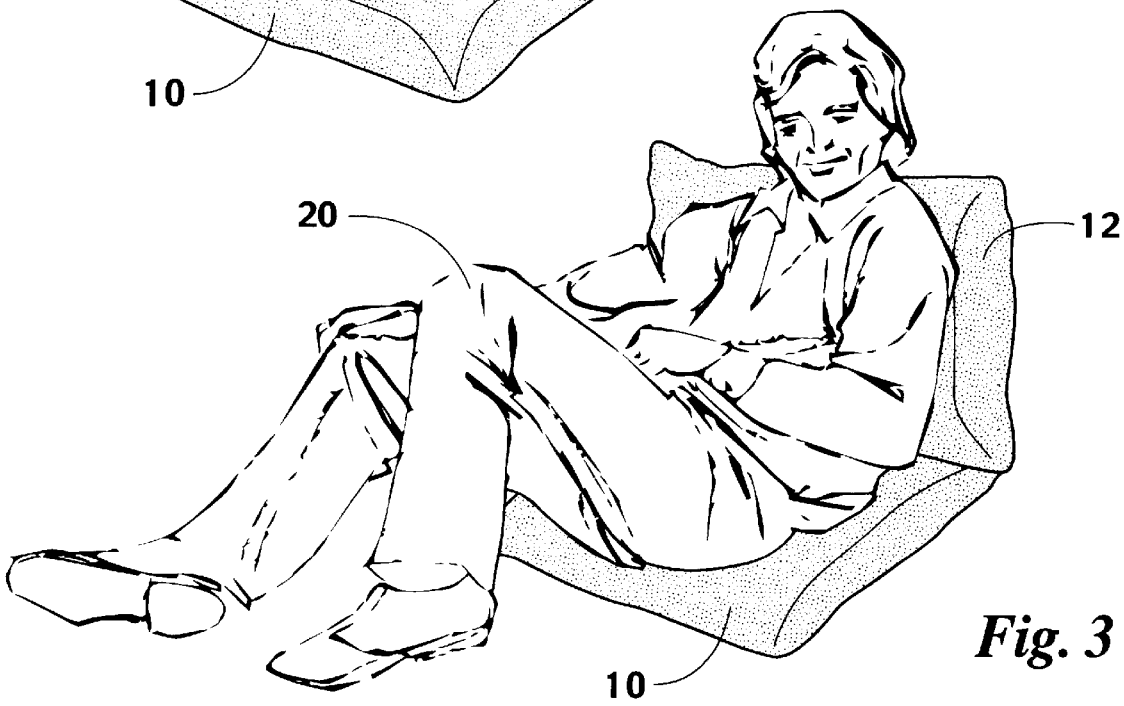
FIG. 3 is a perspective view showing a man sitting on one of the pillows and having the other pillow behind his back forming a comfort seat.

In the double pillow case and anchor pad arrangement shown in FIGS. 1 and 2, the pillowcase sections 10 and 12 can be further defined as having long sides 11 and short sides 13. The center seam 14 is intermediate and parallel with the long sides 11 and the openings 16 for insertion of the pillows (not shown) are adjacent the short sides 13. In FIG. 3 a young adult male 20 is shown as sitting on one of the pillows 10 while having the other pillow 12 propped against a wall or vertical surface so as to provide a comfort seat.

Figure 4:
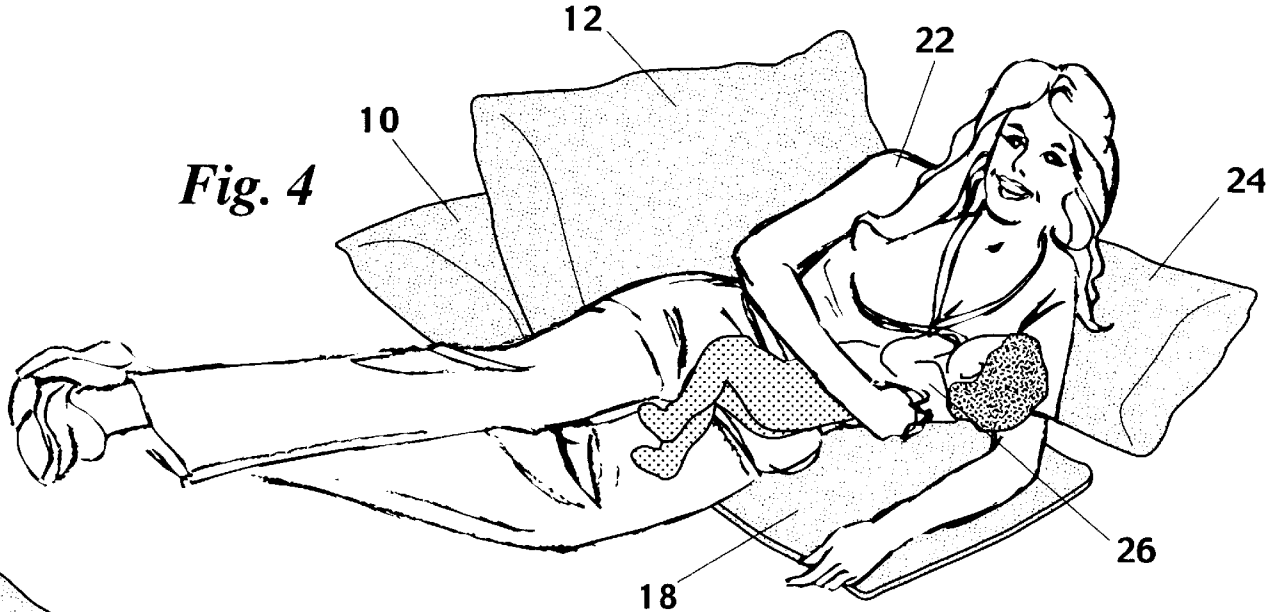
FIG. 4 is a perspective view of a woman with a baby lying on the anchor pad and having the double pillows behind her back and having a separate conventional pillow positioned to receive her head when she is lying down and/or feeding the baby.

In FIG. 4 an adult female 22 is shown as resting her buttocks on the anchor pad 18 with the pillows 10 and 12 being immediately behind her back so as to provide back support. A conventional pillow 24 is positioned so as to receive the head and shoulders of the woman 22 when she lies down fully. Further, FIG. 4 shows an infant 26 being held in the arms of the woman 22. Thus, the woman can recline on the pillow 24 for sleeping or for nursing the infant, as the case may be.

Figure 5:
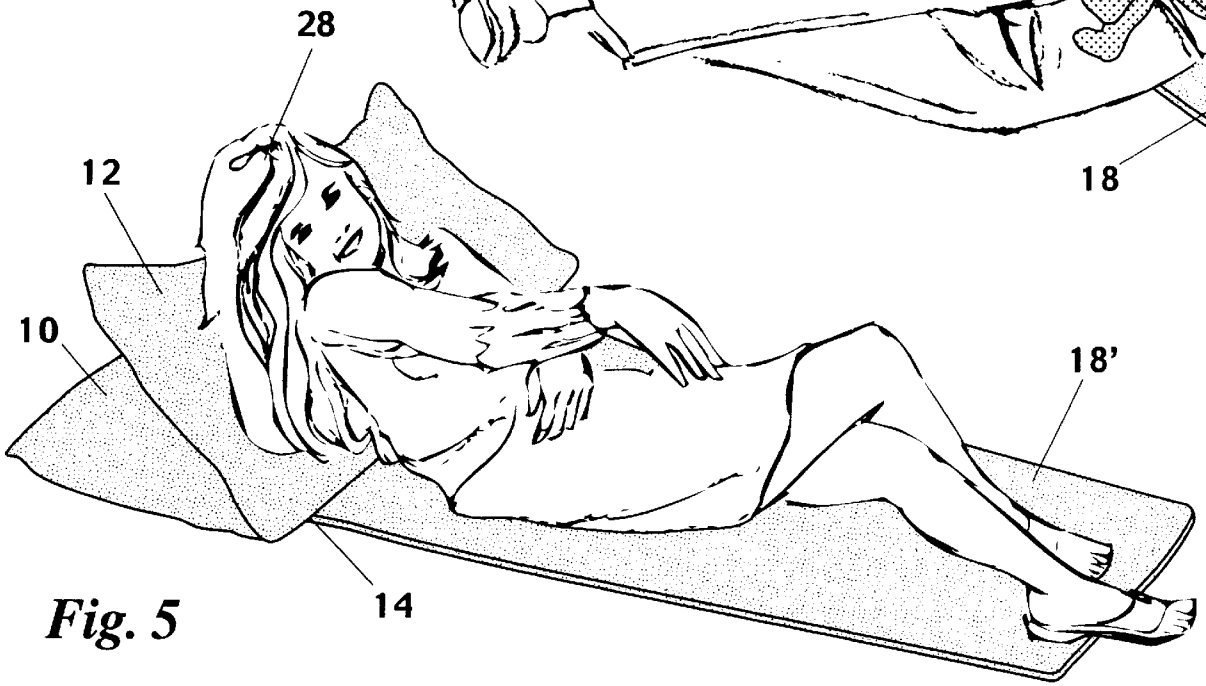
FIG. 5 is a view of a modified form of the present invention wherein the anchor pad is essentially fill body length and showing a young woman lying with her head on the double pillows and her body on the anchor pad.

FIG. 5 shows a modification of the invention where the anchor pad $\mathbf{18}^1$ is considerably longer than the anchor pad 18 of FIGS. 2 and 4. A young woman 28 is shown as lying on the anchor pad $\mathbf{18}^1$ so that the majority of her body is on this anchor pad, the pillows 10 and 12 being behind the head and shoulders of this young lady.

As indicated previously, the anchor pad $\mathbf{18}^1$ in FIG. 5 is essentially full body length, which means that the pad extends from the center seam 14 a sufficient distance to accommodate the legs and torso of the woman 28. Although the anchor pad 18[1] is considerably longer than the anchor pad 18 in FIGS. 2, 4 and 7, it can be seen from the drawings of FIGS. 2 and 7 that the anchor pad 18 is still longer than the short sides 13 of the pillow 10.

Figure 6:
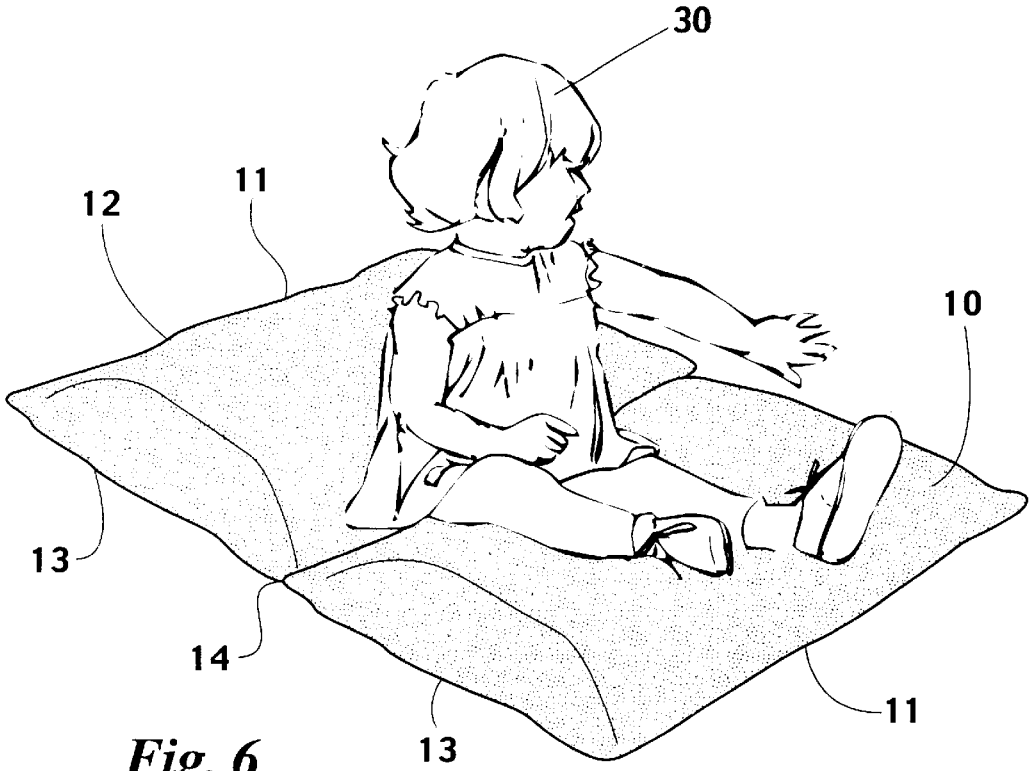
FIG. 6 is a perspective of a toddler sitting in the center of a pillow arrangement similar to that of FIG. 1

In FIG. 6 a toddler 30 is shown as sitting on the two pillows 10 and 12 substantially at the area of the central seam 14.

Figure 7:
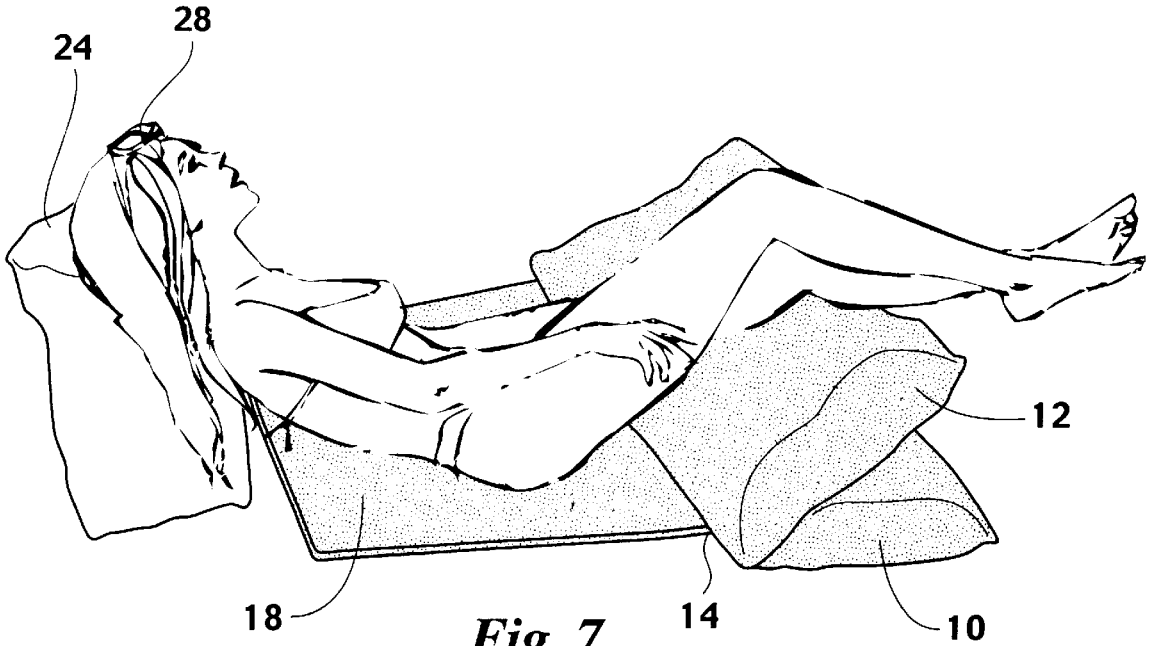
FIG. 7 is a perspective of a young woman sitting on the anchor pad and using the double pillows for leg elevation; a separate conventional pillow is positioned beneath the head of the young lady.

FIG. 7 shows a young woman 28 sitting on the pad 18 with the pillows 10 and 12 beneath her knees to provide leg elevation. A separate conventional pillow 24 can be placed behind the head and shoulders of the young woman. The purpose of the lightly anchor pad 18 or 18[1] is to provide an anchor for the pillows 10 and 12 so that when a person is sitting on the anchor pad 18 as shown in FIG. 4 the pillows 10 and 12 will not move with respect to the woman 22 but will provide a support behind her back. In FIG. 5 which employs a longer anchor pad 181 the pillows 10 and 12 are positioned behind the head and shoulders of the young lady 28 and will not move because her body is on the anchor pad 18[1]. Similarly, when the young lady is seated on the pad 18 in FIG. 7 with the pillows 10 and 12 beneath her knees to provide elevation of the legs, the pillows will not move as long as she remains seated on the pad 18.

In FIG. 7, when the young woman 28 positions the anchor pad 18 under her body so that the seam 14 is relatively close to her buttocks, the pillows 10 and 12 under her knees are in a position to "clamshell". This is true even with large king-size, overstuffed Pillows. The pillows will stay in place due to the user's body weight keeping them in place. The closer the pad is brought up upon the back, the greater the degree of lower body elevation. Conversely, the further the pad is positioned away from the lower back, the less the leg elevation will be. The user can use extra firm, high loft pillows if needed and they will still lift the lower legs or body portion without scooting or movement of the pillows. The user can remove one of the pillows from the pillowcase 10 and get less elevation if desired. When the user reverses her body position on the pad 18 or 18[1] as shown in FIG. 5 for the purpose of providing upper body elevation, the seam end 14 of pad 18 will be approximately at the location of the waist of the woman 28. The double pillows 10 and 12 will elevate the head, shoulders, chest and upper body of the woman 28. The degree of upper body elevation is contingent upon the placement of the pad. The lower down the back that the pad is stationed, the less the upper body is heightened. The user can remove one of the pillows from the pillowcase sections 10 or 12 if less elevation is desired. The function of the anchor pad 18 or 18[1] remains the same. No matter how high or low the upper body elevation is, the pillows will not migrate or scoot out of position due to the anchor pad.

The body of the anchor pad is stitched into the center of the adjoining pillow slips. The anchor pad is cushioned with a polyester batting that yields enough or is cushioned so that the user could use this on a hard surface and enjoy a certain degree of padding under the body.

If the user sits on the anchor pad so that the buttocks is essentially over the seam line 14 the user is able to sit upright on the pillows like a chair with the two pillows behind the users back.

As shown in FIG. 4, the woman 22 is able to lie on her right or left side for back support keeping the pillows 10 and 12 in place behind her back.

Heretofore, it has been indicated what type of material might be employed to make the pillowcases. With respect to the pillows (not shown) which are inserted into the pillowcases, these could be one's existing pillow which, for example, could be made of 100% goose down feathers covered with any conventional cloth material of any acceptable type, or the pillow could be made from foam or polyester. It is even contemplated that the pillow might be inflatable, if desired.

The user could fill the cases 10 and 20 with very firm pillows or, alternatively, with very soft pillows, or one of each in the two cases to obtain a combination of support. The fact of the two separate chambers 10 and 20 allows the user to individualize the pillowcase set as desired. With respect to the anchor pad 18, this is preferably filled with approximately ¼" polyester batting for cushioning and stability, and ease of movement. This feature gives some rigidity to the anchor pad, allowing this ease of movement while preventing the pad from gathering up (wrinkling) under the user's body as he moves or shifts position.

What is claimed is:

1. A double pillowcase assembly comprising a pair of fabric envelopes consisting of a pair of rectangular pillowcase sections, each section being formed by a pair of long sides and a pair of short sides, the envelopes being connected along a central seam line which is intermediate and parallel with the long sides, the envelopes having openings along the short sides for holding pillows in the envelopes and a rectangular anchor pad connected along the central seam line extending outwardly from the double pillowcase a distance greater than the short side, the anchor pad being filled with batting to provide padding.

2. A double pillowcase assembly as set forth in claim 1, wherein the rectangular anchor pad extends outwardly from the double pillowcase a sufficient distance to accommodate the legs and torso of a human supported on the anchor pad.

* * * * *